US008590865B2

(12) United States Patent
Heyman et al.

(10) Patent No.: US 8,590,865 B2
(45) Date of Patent: Nov. 26, 2013

(54) LIQUID AERATOR

(75) Inventors: Frederic W. Heyman, Lawrence, NY (US); Howard Wang, Shatin (HK)

(73) Assignee: Vinomax LLC, Lawrence, NY (US)

( * ) Notice: Subject to any disclaimer, the term of this patent is extended or adjusted under 35 U.S.C. 154(b) by 0 days.

(21) Appl. No.: 13/880,115

(22) PCT Filed: Aug. 2, 2012

(86) PCT No.: PCT/US2012/049318

§ 371 (c)(1), (2), (4) Date: Apr. 18, 2013

(87) PCT Pub. No.: WO2013/022696

PCT Pub. Date: Feb. 14, 2013

(65) Prior Publication Data

US 2013/0207284 A1 Aug. 15, 2013

Related U.S. Application Data

(60) Provisional application No. 61/522,439, filed on Aug. 11, 2011.

(51) Int. Cl.
*B01F 3/04* (2006.01)

(52) U.S. Cl.
USPC ..... 261/111; 261/116; 261/DIG. 75

(58) Field of Classification Search
USPC ..... 261/76, 77, 79.2, 111, 116, DIG. 75
See application file for complete search history.

(56) References Cited

U.S. PATENT DOCUMENTS

| | | | | |
|---|---|---|---|---|
| 3,794,306 | A * | 2/1974 | Engalitcheff, Jr. | 261/116 |
| 4,735,750 | A * | 4/1988 | Damann | 261/29 |
| 6,230,944 | B1 | 5/2001 | Castellano et al. | |
| 6,568,660 | B1 | 5/2003 | Flanbaum | |
| 8,430,023 | B2 * | 4/2013 | Hynes | 99/323.1 |
| 2010/0025867 | A1 | 2/2010 | Benton et al. | |
| 2011/0024461 | A1 * | 2/2011 | Kilduff et al. | 222/190 |
| 2011/0024925 | A1 | 2/2011 | Mauffette | |
| 2012/0156338 | A1 * | 6/2012 | Agarwal et al. | 426/231 |
| 2013/0140721 | A1 * | 6/2013 | Borden et al. | 261/76 |

FOREIGN PATENT DOCUMENTS

EP 2277618 1/2011

OTHER PUBLICATIONS

International Search Report and the Written Opinion dated Jan. 29, 2013 from the corresponding International Application No. PCT/US2012/049318.

* cited by examiner

*Primary Examiner* — Charles Bushey
(74) *Attorney, Agent, or Firm* — Katten Muchin Rosenman LLP

(57) ABSTRACT

Disclosed herein is an aerator for effectively aerating a liquid. The aerator comprises a body having a first opening and a spout defining a fluid flow path of the liquid. A spray head disposed in the fluid flow path having a plurality of spray openings mixes and aerates the liquid with the air from the air inlet as the liquid is sprayed out through the spray openings. The aerator may also contain an angled head portion to allow the aerator to be attached to a bottle.

15 Claims, 12 Drawing Sheets

LIQUID AERATOR

CROSS-REFERENCE TO RELATED APPLICATIONS

The present application claims priority to U.S. Provisional Application No. 61/522,439, filed Aug. 11, 2011, the entire contents of which are incorporated by reference in their entirety.

FIELD OF THE INVENTION

The present application is directed to an aerator for aerating a liquid prior to consumption. More particularly, the present application is directed to an aerator having multiple aeration sites.

BACKGROUND

It is well known that certain liquids, like wine, taste better when there is an opportunity to have the liquid aerated prior to drinking. In some cases, after wine is opened, it is simply left in air to permit the air to get into the wine bottle. However, often that is insufficient and may take a considerable amount of time to get adequate aeration to bring out the flavors contained in the wine.

Various types of aerators have been developed to facilitate or add the ability to provide aeration to the liquid, either prior to or as it is being poured into a glass. However, most types of aerators only provide a single aeration site which may not fully aerate the liquid. Therefore, a need clearly exists for an aerator capable of more fully aerating a liquid.

SUMMARY OF THE INVENTION

According to one embodiment of the invention, disclosed herein is an aerator for aerating a liquid (e.g., wine, spirits, etc.) comprising a body having a first opening of a first size at one end and a spout opening of a second size at an opposite end defining a fluid flow path of the liquid through the body from the first opening to the spout opening; at least one air inlet configured to introduce external air into the fluid flow path, and a spray head disposed in the fluid flow path having a plurality of spray openings. Liquid passing through the fluid flow path sprays through the spray openings of the spray head for mixing with the air from the at least one air inlet. Preferably, the body of the aerator is formed from a hard clear plastic.

In some embodiments, the aerator may further comprise an umbrella located downstream the fluid flow path from the spray head to further disperse the liquid. In order to increase the speed of the liquid flowing through the fluid flow path, the spray head may comprise a bypass tube in the center of the spray head to allow some liquid to bypass the openings of the spray head.

The aerator may further comprise a first cup located upstream the fluid flow path from the spray head for preventing liquid overflow and a second cup located downstream the fluid flow path from the spray head for collecting fluid that exits the openings of the spray head.

Further, the aerator may comprise an exit passageway located downstream the fluid flow path from the spray head, the exit passageway having an upper compartment and a lower compartment terminating at the spout opening. In order to promote aeration, the upper compartment and the lower compartment taper outward from a meeting point.

In some embodiments, the aerator may comprise an angled head portion having an air inlet pipe in fluid communication with the at least one air inlet and a gasket for forming an airtight seal between the aerator and a circular neck of a bottle containing liquid. This allows the aerator to be attached directly to a bottle of wine, for example. In order to facilitate attachment, the gasket may comprise a plurality of flanges for engaging the circular neck of a wine bottle. The air inlet pipe introduces air into the bottle from the at least one air inlet as liquid from the bottle flows along the fluid flow path of the aerator, thus allowing further aeration of the liquid.

DETAILED DESCRIPTION OF THE PREFERRED EMBODIMENTS

Figure 1:
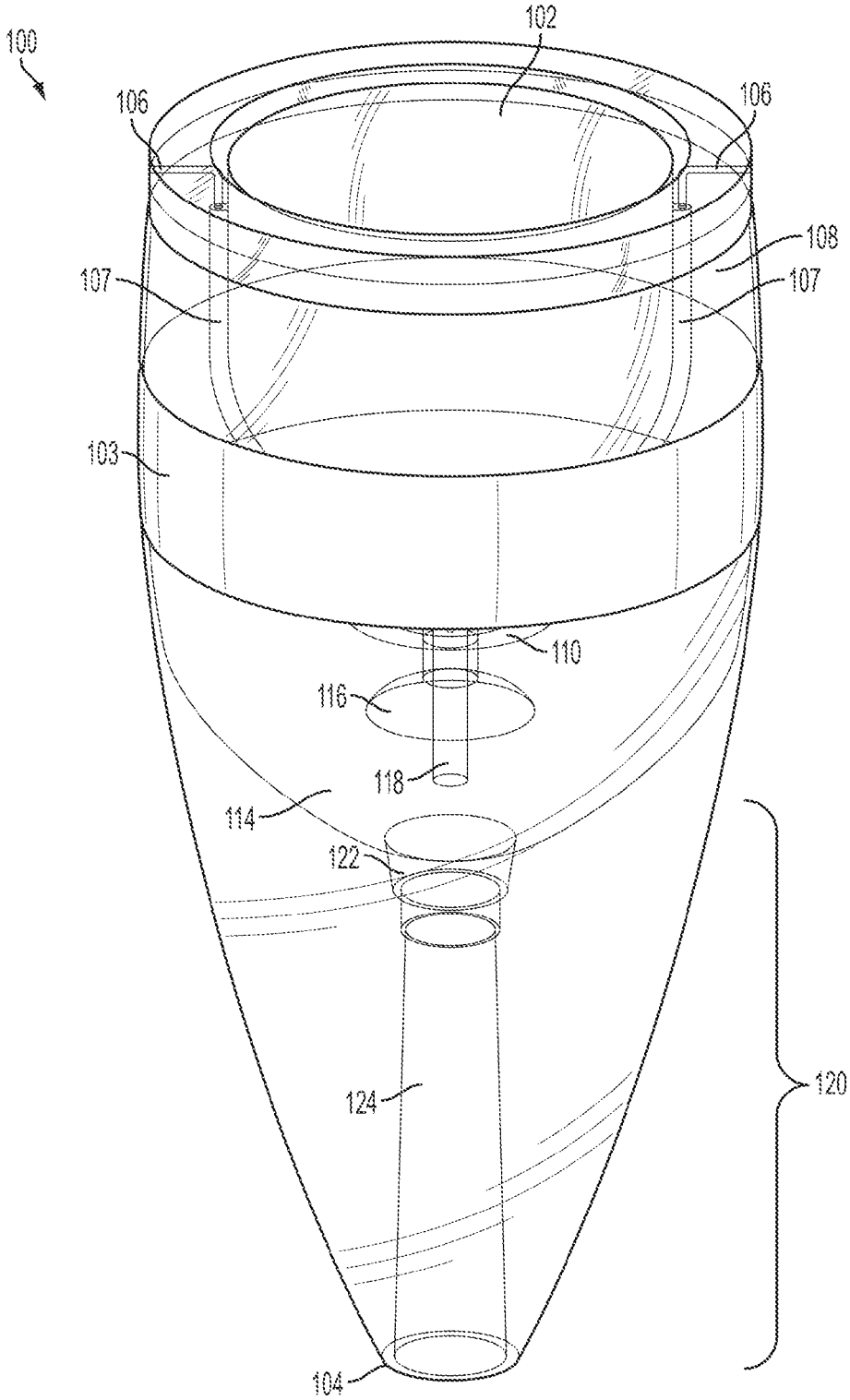
FIG. 1 is a perspective view of a first embodiment of the aerator.
Figure 2:
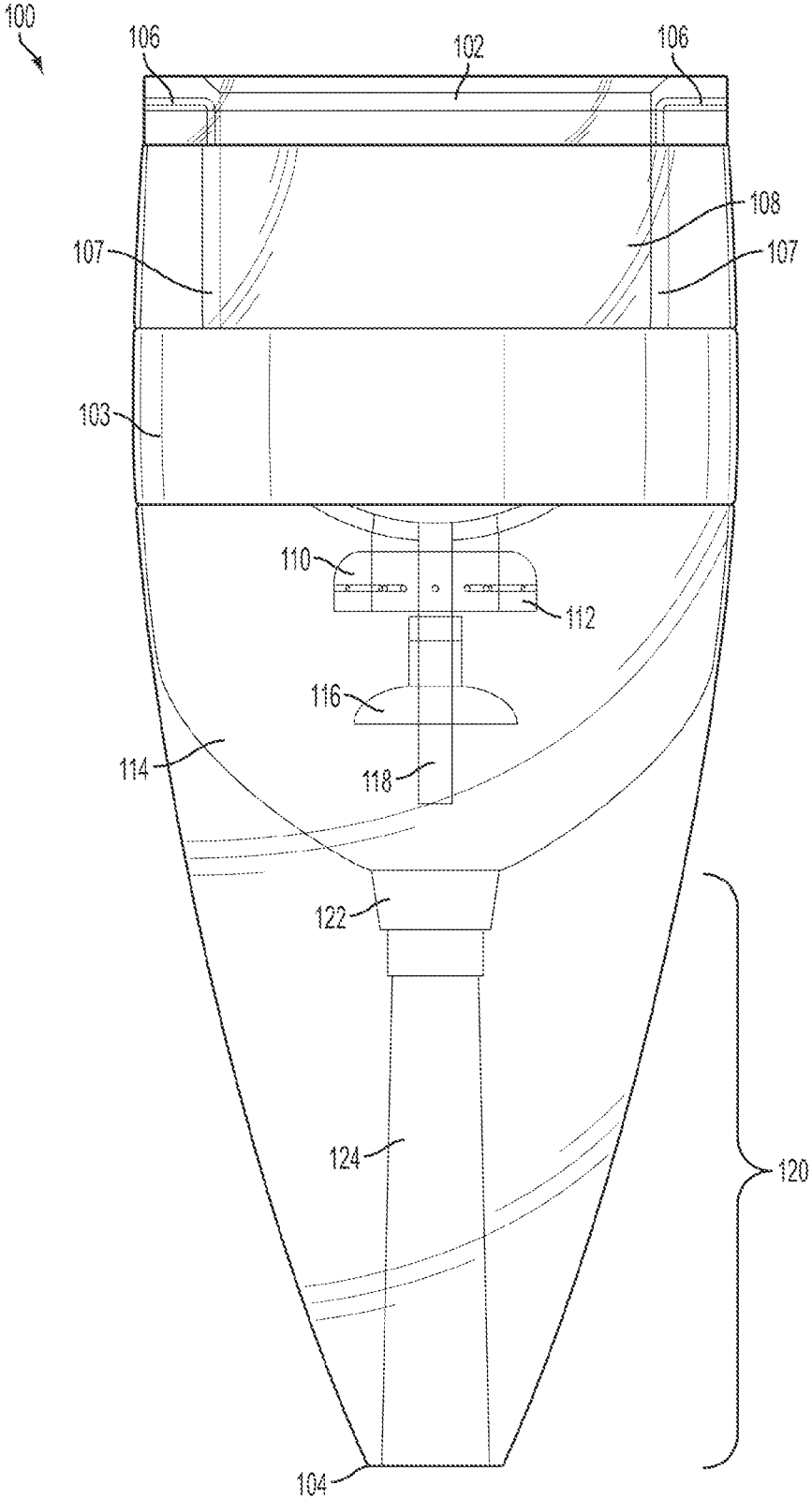
FIG. 2 is a side view of the aerator of FIG. 1.
Figure 3:
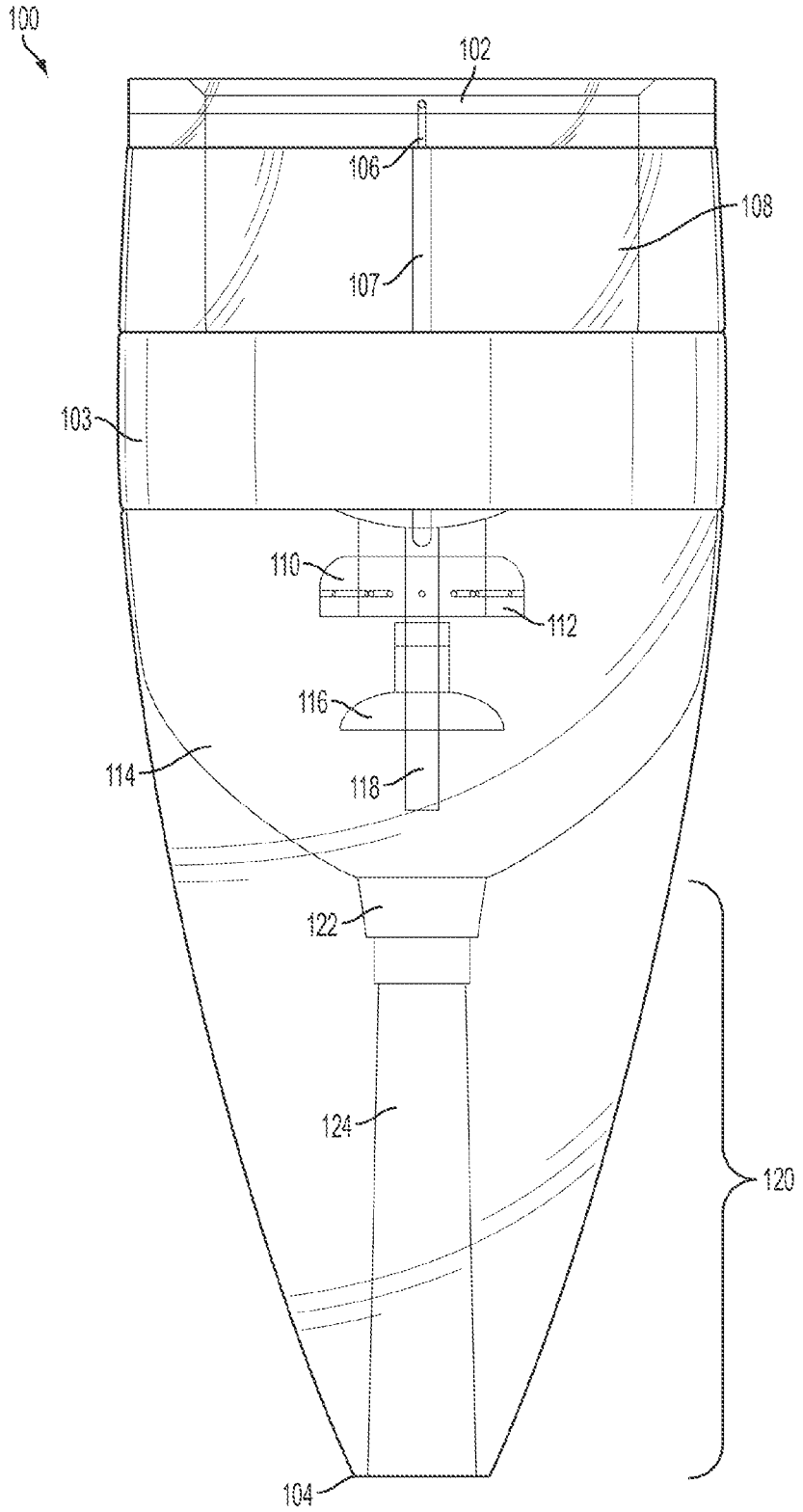
FIG. 3 is a front view of the aerator of FIG. 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Referring first to FIGS. 1-4, depicted is aerator 100 according to a first embodiment of the invention. Generally, aerator 100 has an elongated frusto-conical shape to allow aerator 100 to easily be held by a user or placed in a stand and to provide a long fluid flow path for ample aeration. As shown, aerator 100 comprises first opening 102 and spout opening 104 defining a fluid flow path therebetween Air inlets 106 allow external air to enter aerator 100 and mix with liquid (e.g., wine) through passage way 107 as it is poured through aerator 100.

Aerator 100 is preferably formed from a hard clear plastic material. By using a clear material, a user can observe the aeration as a liquid is poured through aerator 100. Further, aerator 100 may be provided with circular band 103 around its periphery. Circular band 103 can be utilized for branding and/or provide a user with a convenient location for holding aerator 100 while pouring a liquid therethrough.

Figure 4:
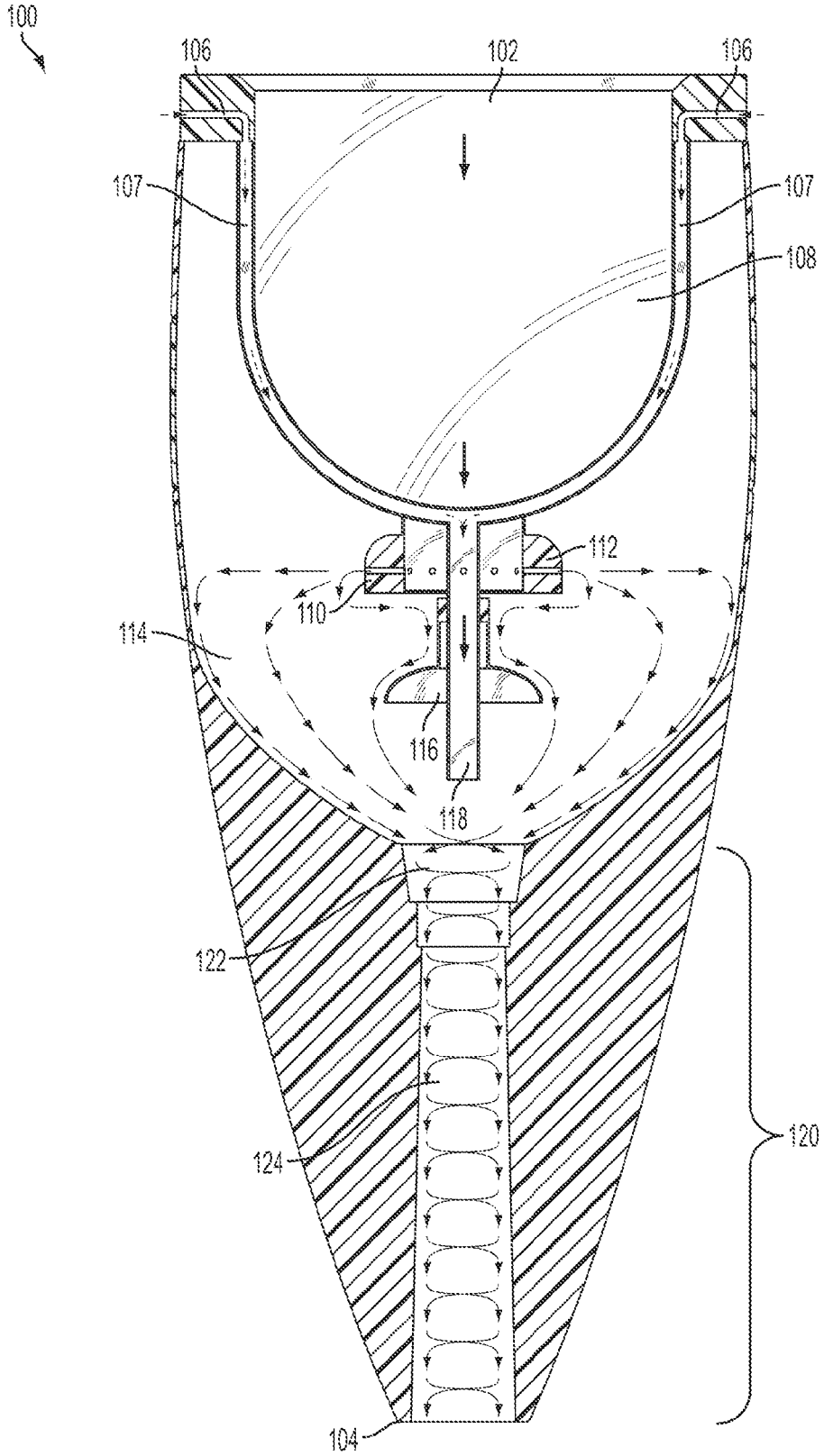
FIG. 4 is a side cutaway view of the aerator of FIG. 1.
Figure 5:
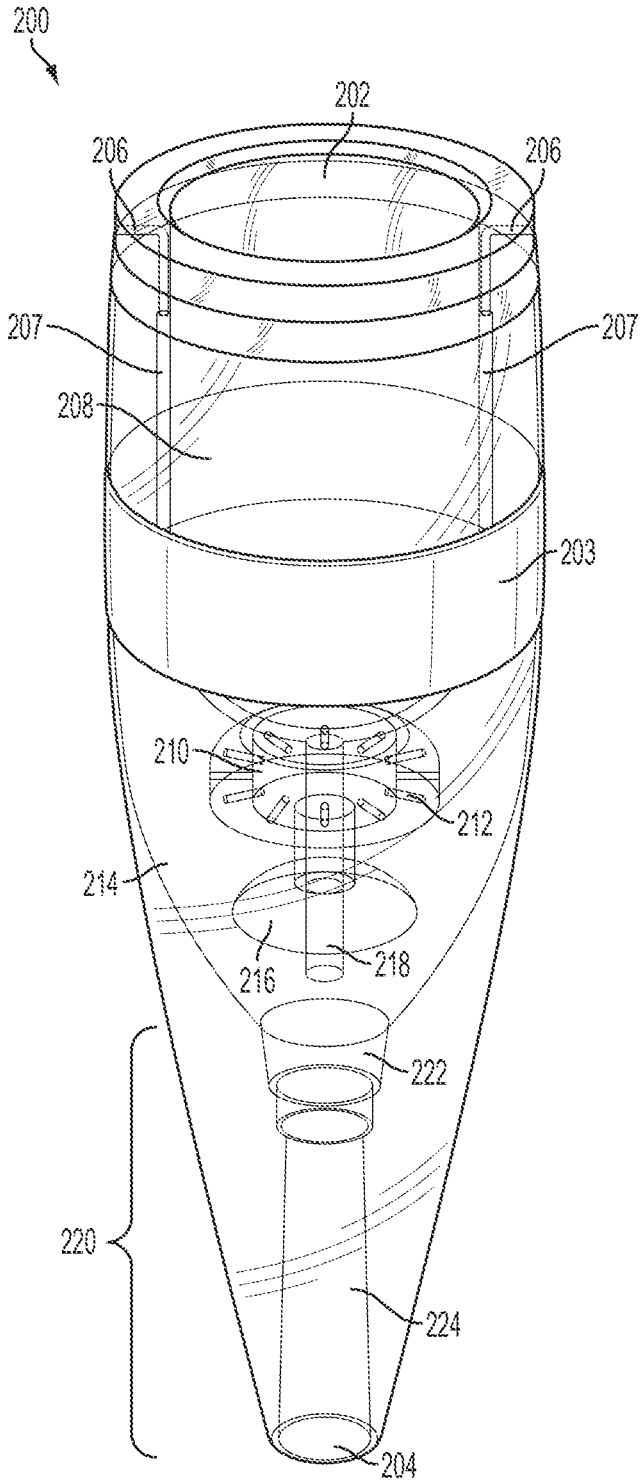
FIG. 5 is a perspective view of a second embodiment of the aerator.

The flow path of liquid and air through aerator 100 is depicted in FIG. 4. Solid line arrows represent the path of the liquid while dashed line arrows represent the path of air. As liquid is poured through opening 102, it enters first cup 108. Preferably, first cup 108 is shaped such that it directs the liquid from cup 108 into spray head 110. As the liquid enters spray head 110, a portion of the liquid is sprayed out through spray openings 112 and mixes with air from air inlets 106 in second cup 114. However, some of the liquid may not be forcibly sprayed against the walls of second cup 114. In order to aid in aeration of this liquid, umbrella 116 is provided in order to further disperse the remaining liquid for effective mixture with the air in second cup 114.

Provided in the center of spray head 108 is bypass tube 118 which allows a portion of the liquid to flow directly from first cup 108 to second cup 114, thereby bypassing both spray head 110 and umbrella 116. Bypass tube 118 serves to increase the flow of the liquid along the fluid flow path of aerator 100. However, bypass tube 118 can be omitted from aerator 100.

After the liquid enters second cup 114, it proceeds to flow through exit passageway 120 and leaves aerator 100 through spout opening 104. Preferably, exit passageway 120 comprises upper portion 122 and lower portion 124. As shown in FIGS. 1-4, upper portion 122 first tapers inward and lower portion 124 tapers outward from where the two portions meet. As the liquid flows through these passageways, it causes the liquid to swirl around in a spiral and form bubbles. This serves to further aerate the liquid by increasing its dispersal as the liquid flows through passageway 120 until it exits spout opening 104.

By making aerator 100 transparent, a user can see the liquid spraying through spray head 110 like a shower head. A user can also see the liquid dispersed by umbrella 116 and further see the swirl of the liquid in exit passageway 120.

A base (not shown) can be provided to hold aerator 100 in place while it is being stored. Additionally, it should be noted that the bottom of aerator 100 is flat so that the aerator can actually stand on its own even without the presence of the base if necessary. Further, a stand (not shown) may be provided for holding aerator 100 above a glass while liquid is being poured through aerator 100.

Referring now to FIGS. 5-8, depicted is a narrower, or "travel," aerator 200 which comprises the same internal components as aerator 100 that have already been described. As shown, aerator 200 comprises first opening 202, circular band 203, spout opening 204, air inlets 206, passageway 207, first cup 208, spray head 210 with spray openings 212, second cup 214, umbrella 216, bypass tube 218, and exit passageway 220 having upper portion 222 and lower portion 224.

Figure 6:
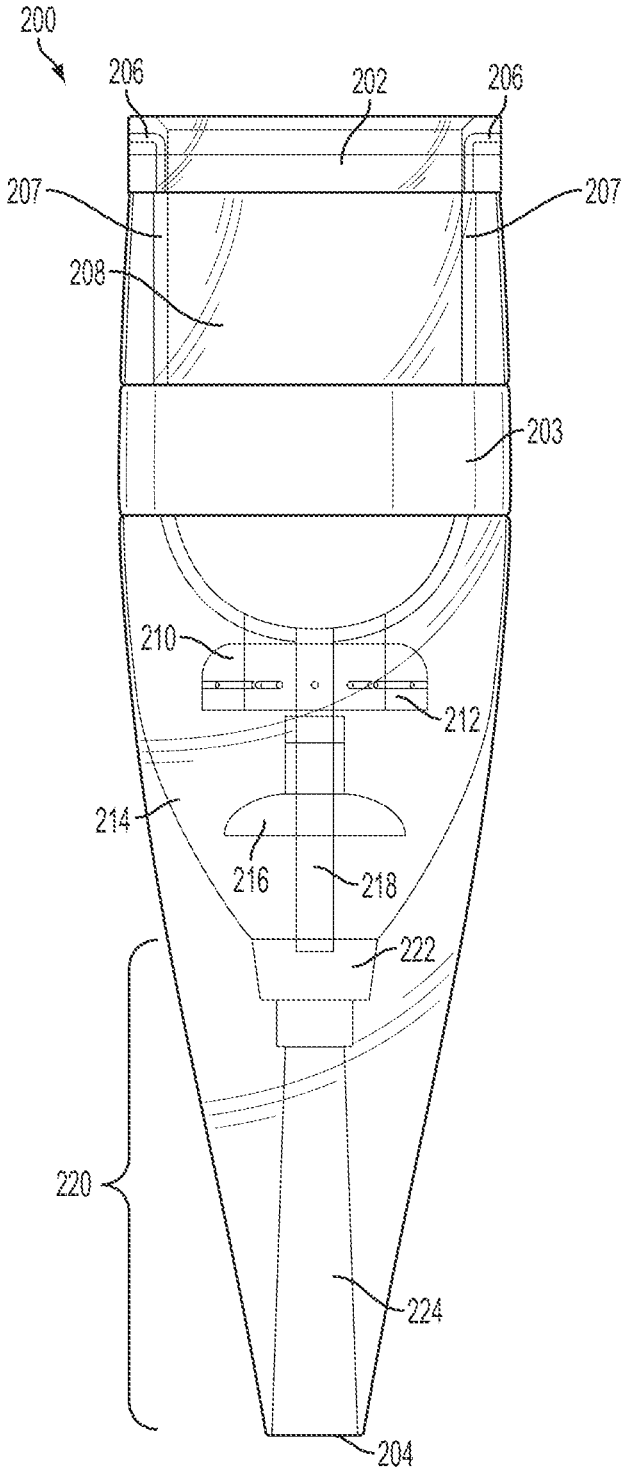
FIG. 6 is a side view of the aerator of FIG. 5.
Figure 7:
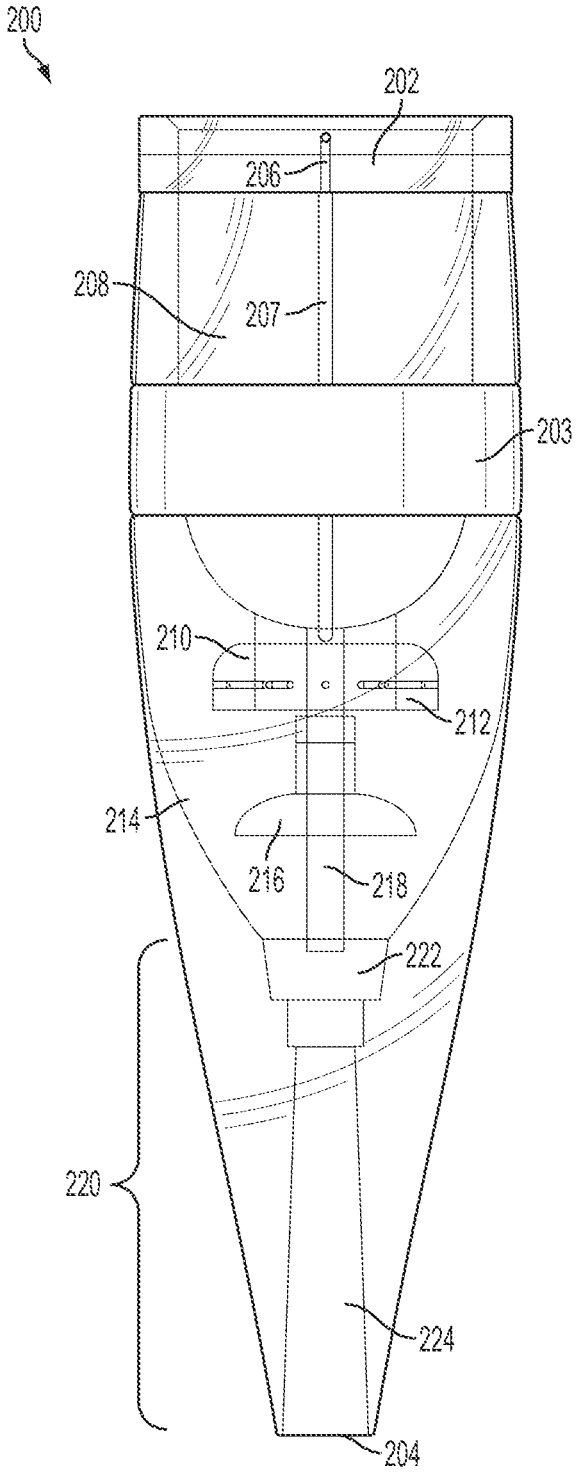
FIG. 7 is a front view of the aerator of FIG. 5.
Figure 8:
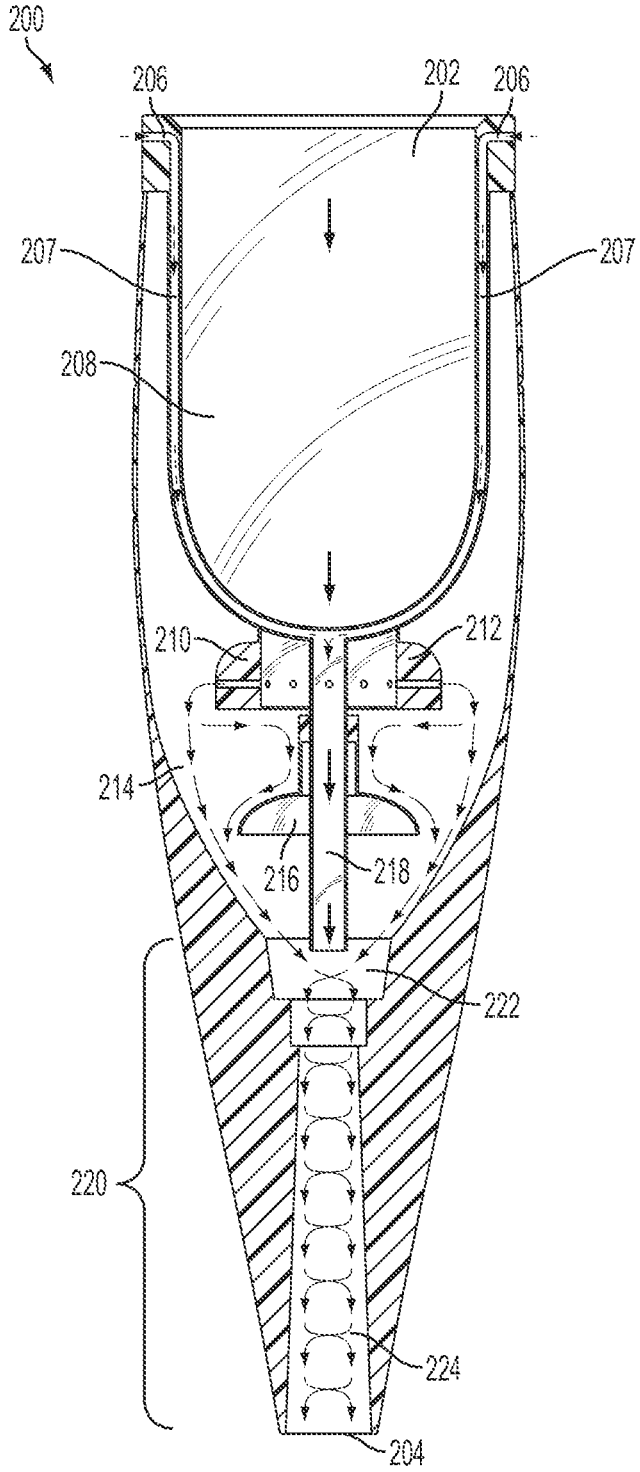
FIG. 8 is a side cutaway view of the aerator of FIG. 5.
Figure 9:
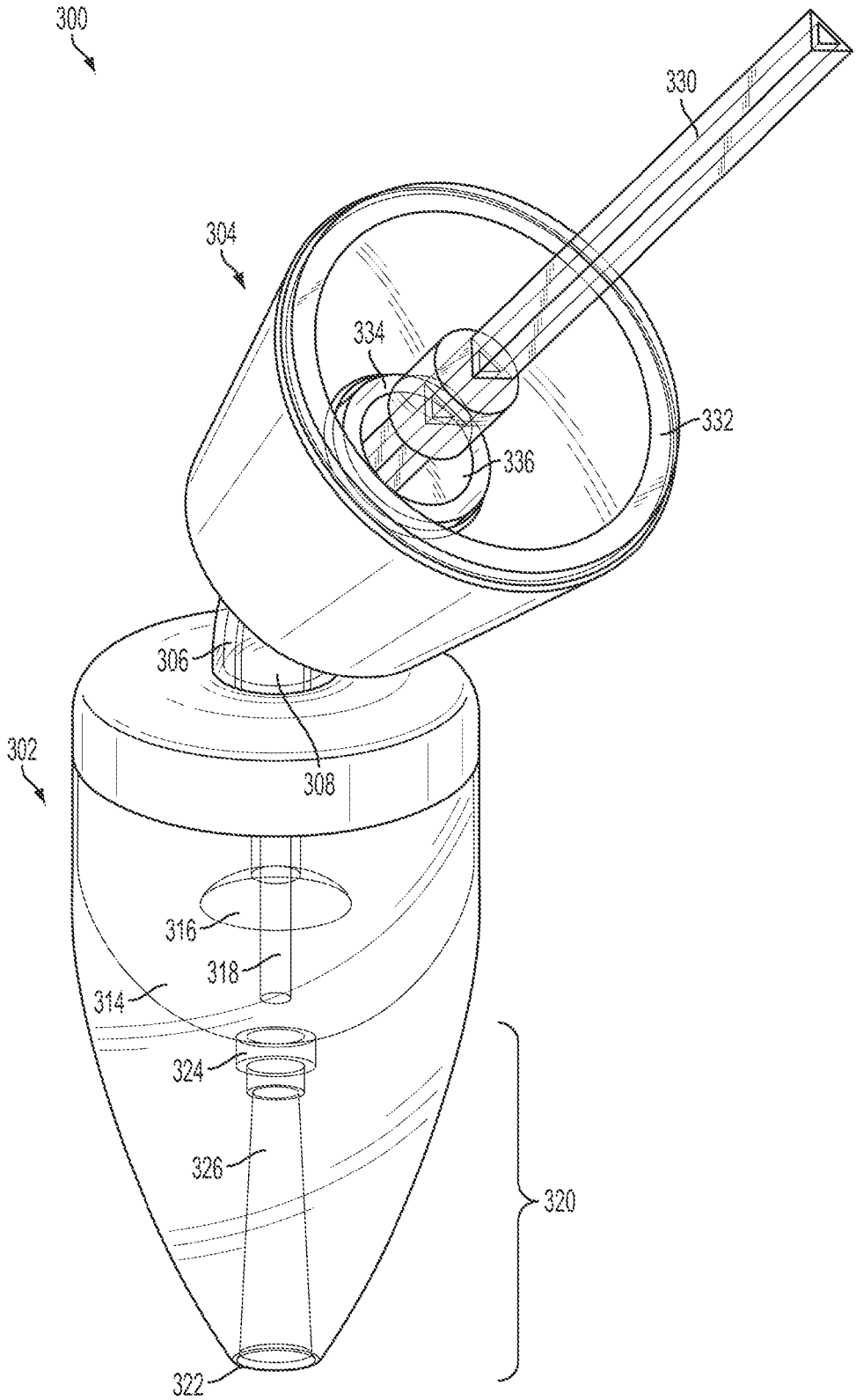
FIG. 9 is a perspective view of a third embodiment of the aerator.
Figure 10:
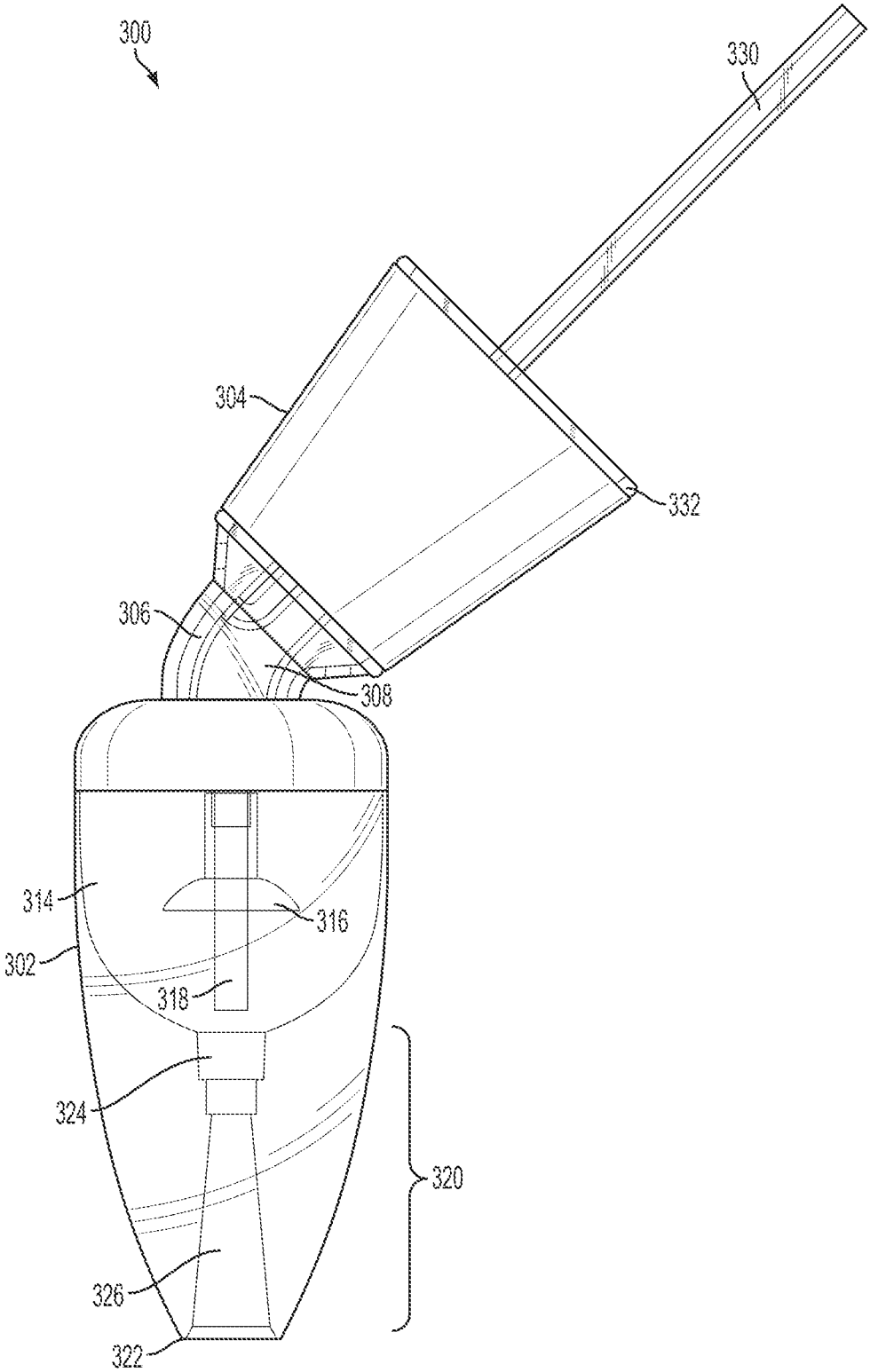
FIG. 10 is a side view of the aerator of FIG. 9.
Figure 11:
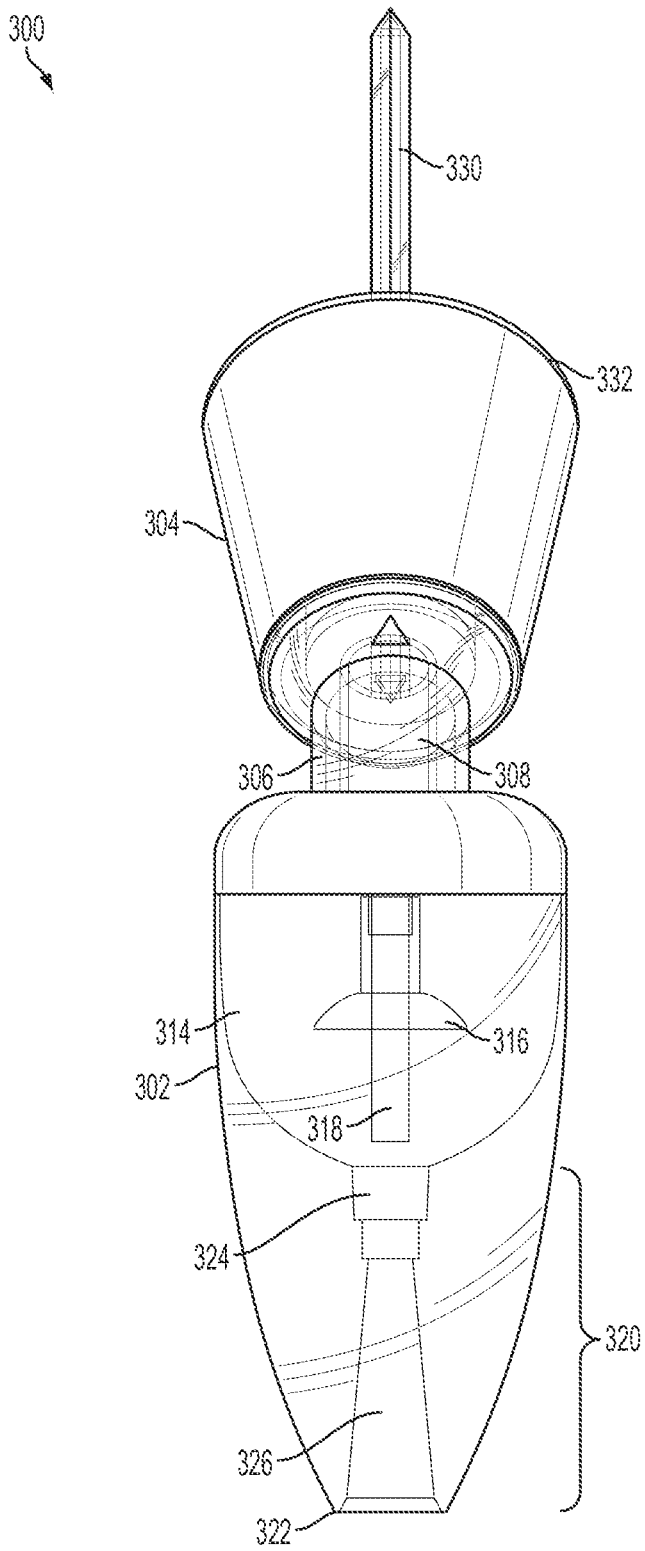
FIG. 11 is a front view of the aerator of FIG. 9.

For brevity, only the differences between aerator 200 and aerator 100 will be explained. As shown in FIGS. 6-8, bypass tube 202 extends partially into exit passageway 204. Otherwise, as shown in FIG. 8, the flow of liquid and air through aerator 200 is substantially similar to that of aerator 100.

FIGS. 9-12 depict an alternate embodiment showing aerator 300 that can be removably attached to a bottle having a neck (e.g. a wine bottle). Aerator 300 comprises body 302 and head portion 304 which are joined by angled connector 306 by a fixed or swivel connection. Body 302 and angled connector 306 are preferably formed from a hard clear plastic.

Figure 12:
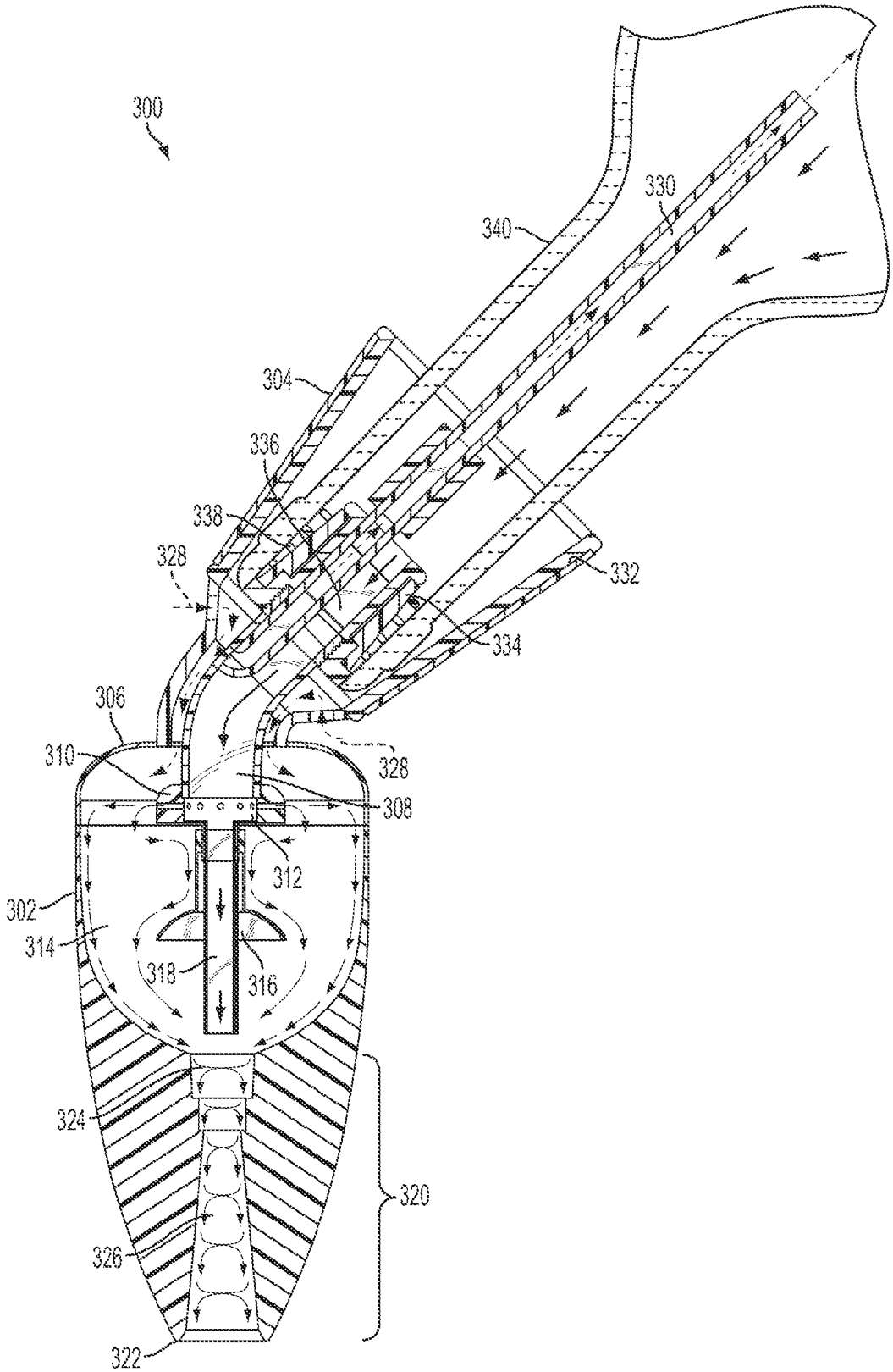
FIG. 12 is a side cutaway view of the aerator of FIG. 9.

Head portion 302 comprises air inlets 328, air inlet tube 330, cover 332, cork 334, and tube 336. As shown in FIG. 12, air inlets 328 are in fluid communication with cup 314 and air inlet tube 330. Air inlet tube may have any desired cross-section shape such as triangular, circular, etc. Tube 336 is in fluid communication with tube 308. When aerator 300 is placed on bottle 340, cover 332 extends over the outside of the neck of bottle 340 and cork 334 provides an airtight seal with the inside of bottle 340. Cork 334 is preferably made from a flexible rubber or silicone material. Flanges 336, provided on cork 334, allow the cork to remain in bottle 340 via a friction fit even when bottle 340 is tilted for pouring. Further, cover 332 may contain threads (not shown) to engage with threads on bottle 340 if they are present.

After aerator 300 is placed on bottle 340, the liquid in bottle 340 can flow into tube 308 through tube 336 as bottle 340 is titled. At the same time, air from air inlets 328 can flow into bottle 340 through air inlet tube 330. As depicted in FIG. 12, the flow of a liquid through body 302 and angled connector 306 is substantially similar to that of aerator 100 and aerator 200. First, liquid enters tube 308 located in neck portion 306 as bottle 340 is titled. Gravity forces a portion of the liquid to spray through holes 312 located in spray head 310 against the inner wall of cup 314. The sprayed liquid mixes with air from air inlets 328. However, some of the liquid may not be forcibly sprayed against the walls of cup 314. In order to aid in further aeration of this liquid, umbrella 318 is provided in order to further disperse the remaining liquid for effective mixture with the air in cup 314.

Provided in the center of spray head 310 is bypass tube 318 which allows a portion of the liquid to flow directly from tube 308 to cup 314, thereby bypassing both spray head 310 and umbrella 316. Bypass tube 318 serves to increase the flow of the liquid along the fluid flow path of aerator 300.

After the liquid enters cup 314, it proceeds to flow through exit passageway 320 and leaves aerator 300 through spout opening 322. Preferably, exit passageway 320 comprises upper portion 324 and lower portion 326. As shown in FIGS. 9-12, upper portion 324 tapers inward and lower portion 326 tapers outward from where the two portions meet. As the liquid flows through these passageways, it causes the liquid to swirl around in a spiral and form bubbles. This serves to further aerate the liquid by increasing its dispersal as the liquid flows through exit passageway 320 until it exits spout opening 322.

In sum, the liquid is first aerated by air that enters bottle 340 through air inlet tube 330 as the liquid is being poured. Further aeration occurs as the liquid mixes with air in cup 314 as it is sprayed out of spray openings 312 in spray head 310. Aeration also occurs as the liquid swirls through exit passageway 320.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An aerator for aerating a liquid comprising:

a body having a first opening of a first size at one end and a spout opening of a second size at an opposite end defining a fluid flow path of the liquid through the body from the first opening to the spout opening;

at least one air inlet configured to introduce external air into the fluid flow path;

a spray head disposed in the fluid flow path having a plurality of spray openings, wherein at least a portion of liquid passing through the fluid flow path is sprayed out through the spray openings of the spray head for mixing with the air from the at least one air inlet; and an umbrella located downstream the fluid flow path from the spray head to further disperse and aerate the liquid.

2. The aerator of claim 1, wherein the body is formed from a hard plastic material.

3. The aerator of claim 2, wherein the hard plastic material is clear.

4. The aerator of claim 1, wherein the first opening is wider than the spout opening.

5. The aerator of claim 1, wherein the flow of liquid exiting the spray openings of the spray head is substantially perpendicular to the flow of liquid entering the spray head.

6. The aerator of claim 1, further comprising:

a first reservoir cup located upstream the fluid flow path from the spray head; and a second reservoir cup located downstream the fluid flow path from the spray head for collecting fluid that exits the openings of the spray head.

7. The aerator of claim 1, further comprising:

an exit passageway located downstream the fluid flow path from the spray head, the exit passageway having an upper flow tube and a lower flow tube terminating at the spout opening, wherein the upper flow tube and the lower flow tube compartment taper outward from a meeting point.

8. The aerator of claim 1, further comprising:

a head portion comprising:

an air inlet pipe in fluid communication with the at least one air inlet; and a gasket for forming an airtight seal between the aerator and a circular neck of a bottle containing liquid.

9. The aerator of claim 8, wherein the gasket comprises a cork with flanges for engaging the circular neck of the bottle.

10. The aerator of claim 8, wherein, the air inlet pipe introduces air into the bottle from the at least one air inlet as liquid from the bottle flows along the fluid flow path of the aerator.

11. The aerator of claim 8, wherein the air inlet pipe and the gasket are connected to the body of the aerator via an angled connector.

12. The aerator of claim 8, wherein the air inlet pipe is located in the center of the gasket.

13. The aerator of claim 8, wherein the air inlet pipe has a triangular cross-section.

14. An aerator for aerating a liquid comprising:

a body having a first opening of a first size at one end and a spout opening of a second size at an opposite end defining a fluid flow path of the liquid through the body from the first opening to the spout opening;

at least one air inlet configured to introduce external air into the fluid flow path; and a spray head disposed in the fluid flow path having a plurality of spray openings, wherein at least a portion of liquid passing through the fluid flow path is sprayed out through the spray openings of the spray head for mixing with the air from the at least one air inlet, and wherein the spray head comprises a bypass tube in a center of the spray head, wherein at least a portion of liquid passing through the fluid flow path flows through the bypass tube.

15. An aerator for aerating a liquid comprising:

a body having a first opening of a first size at one end and a spout opening of a second size at an opposite end defining a fluid flow path of the liquid through the body from the first opening to the spout opening;

at least one air inlet configured to introduce external air into the fluid flow path;

a spray head disposed in the fluid flow path having a plurality of spray openings, wherein at least a portion of liquid passing through the fluid flow path is sprayed out through the spray openings of the spray head for mixing with the air from the at least one air inlet, and wherein the spray head comprises a bypass tube in a center of the spray head, wherein at least a portion of liquid passing through the fluid flow path flows through the bypass tube; and an exit having an upper flow tube and a lower flow tube terminating at the spout opening, wherein the upper flow tube and the lower flow tube compartment taper outward from a meeting point and wherein the upper flow tube does not comprise an air input source disposed therein.

* * * * *